US007168141B2

(12) United States Patent
Stündl et al.

(10) Patent No.: US 7,168,141 B2
(45) Date of Patent: Jan. 30, 2007

(54) METHOD AND APPARATUS FOR STUFFER BOX CRIMPING A MULTIFILAMENT YARN

(75) Inventors: Mathias Stündl, Wedel (DE); Stefan Kalies, Hoffeld (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/167,809

(22) Filed: Jun. 27, 2005

(65) Prior Publication Data

US 2006/0005365 A1 Jan. 12, 2006

(30) Foreign Application Priority Data

Jul. 9, 2004 (DE) ..... 10 2004 033683

(51) Int. Cl.
*D02G 1/12* (2006.01)

(52) U.S. Cl. ..... 28/263; 28/267

(58) Field of Classification Search ..... 28/263, 28/267, 264, 268, 221, 265, 258, 250, 248, 28/254–257, 271, 274, 276; 57/289, 333, 57/350, 351, 908

See application file for complete search history.

(56) References Cited

U.S. PATENT DOCUMENTS 3,751,778 A * 8/1973 Grosjean et al. ..... 28/255
3,802,038 A * 4/1974 Bauch et al. ..... 28/255
4,148,179 A * 4/1979 Becker et al. ..... 57/350
4,268,940 A * 5/1981 Kuroda et al. ..... 28/255
5,054,173 A * 10/1991 Schafer ..... 28/263
5,727,293 A * 3/1998 Weder ..... 28/249
6,085,395 A * 7/2000 Weiss ..... 28/221
6,826,813 B2 * 12/2004 Koslowski et al. ..... 28/263

FOREIGN PATENT DOCUMENTS

DE 44 35 923 A1 4/1995

* cited by examiner

*Primary Examiner*—Amy B. Vanatta
(74) *Attorney, Agent, or Firm*—Alston & Bird LLP

(57) ABSTRACT

A method and an apparatus for stuffer box crimping a multifilament yarn consisting of one or more fiber bundles, wherein a conveying fluid is introduced into a yarn channel via a plurality of fluid feed channels, with each channel carrying a partial flow. The yarn is pneumatically taken into the yarn channel, and guided, and possibly twisted in the yarn channel by the conveying fluid, and subsequently advanced into a stuffer box chamber. Inside the stuffer box chamber, the yarn is formed into a plug which is compressed and advanced, with the conveying fluid emerging from the stuffer box chamber through side openings. To influence the actions of the conveying fluid on the yarn within the yarn channel, at least one of the fluid feed channels is configured such that the partial flows of the conveying fluid are introduced from the fluid feed channels into the yarn channel under the action of different overpressures.

20 Claims, 5 Drawing Sheets

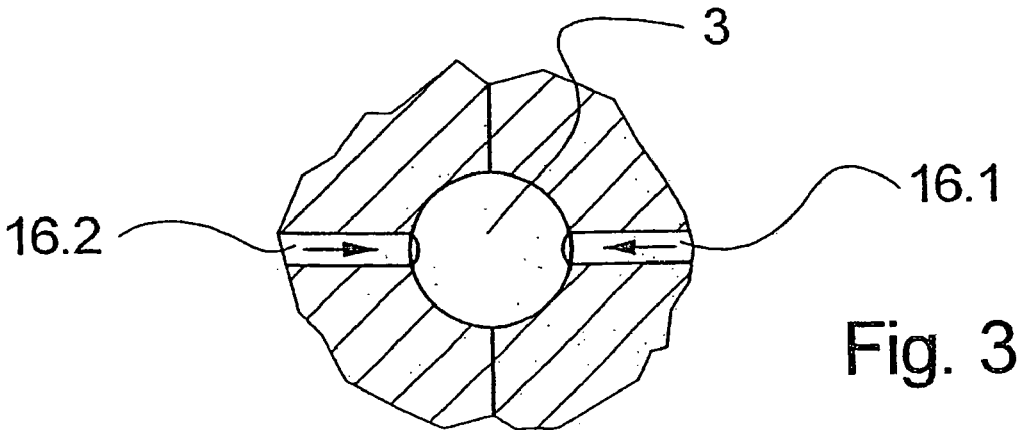
Fig. 3.1
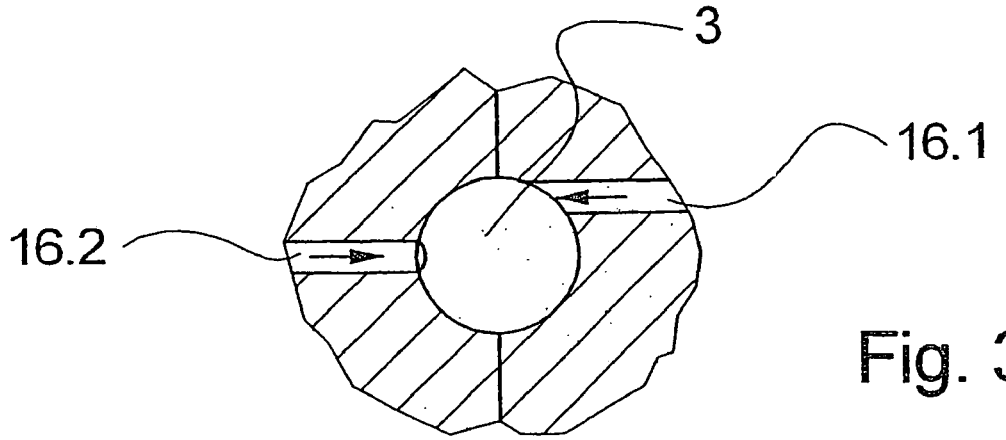
Fig. 3.2
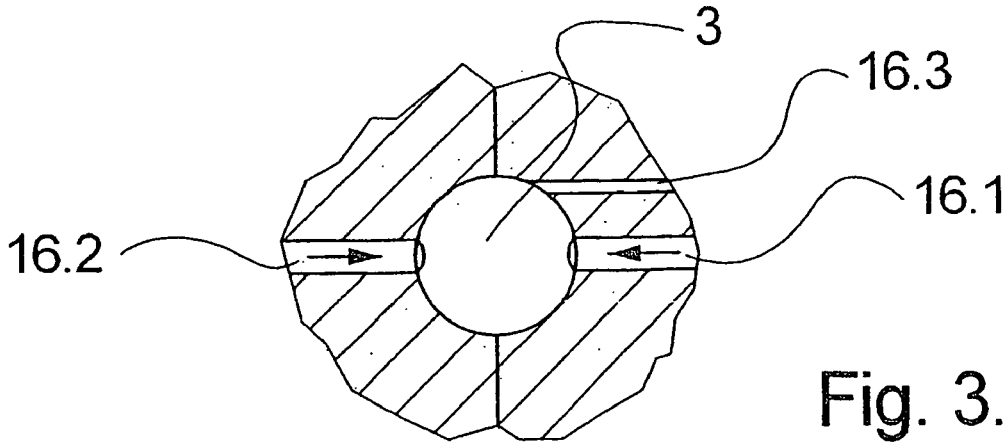
Fig. 3.3

METHOD AND APPARATUS FOR STUFFER BOX CRIMPING A MULTIFILAMENT YARN

BACKGROUND OF THE INVENTION

The present invention relates to a method for stuffer box crimping a multifilament yarn, as well as an apparatus for carrying out the method.

In the production of melt spun crimped yarns, it is known to compress the multifilament yarns to a yarn plug in a stuffer box chamber for purposes of crimping, so that the filaments of the yarn collect in loops and coils on the surface of the yarn plug and are compacted therein. In this process, a feed nozzle pneumatically advances the multifilament yarn into the stuffer box chamber. To this end, the feed nozzle comprises a yarn channel, into which a plurality of fluid feed channels terminate, through which a conveying fluid enters the yarn channel under an overpressure. The conveying fluid which is preferably heated thus causes the multifilament yarn to enter the yarn channel and advance therein.

A method and an apparatus of this type are disclosed, for example, in DE 44 35 923 A1.

In the known method and apparatus, the feed nozzle comprises guide means in a central supply channel for the conveying fluid, so as to obtain in an annular channel a preferred direction of flow of the conveying fluid. The annular channel supplies a plurality of fluid feed channels that connect the annular channel to the yarn channel. The oriented flow thus causes inside the yarn channel a twisting action to develop, which leads to a twisting of the yarn. To influence the twisting action on the yarn, it is proposed to adjust the guide means, so as to orient the flow in the annular channel to a greater or lesser extent. Depending on the yarn type, different requirements are to be met. On the one hand, a twist is desired for increasing a reliable advance, in particular upon the entry of the yarn. On the other hand, excessive twisting of the yarn may interfere with achieving a high crimp. In this respect, it is desirable to adjust the twisting action at the feed nozzle as precisely as possible. However, the known system is suited only to a limited extent for precisely adjusting and varying the twisting action on a multifilament yarn in a wider range.

In particular, it is necessary that such texturing nozzles be suited for reliably guiding both multifilament yarns consisting of a plurality of yarn bundles, for example, for the production of three-color yarns, and multifilament yarns consisting of one filament bundle, for example, for the production of single-color yarns, and for advancing them into an adjacent stuffer box chamber. In this process, quite different requirements are to be met by a twisting action of the feed nozzle, which the known solutions, however, accomplish only inadequately.

It is therefore an object of the invention to provide a method and an apparatus of the initially described type for stuffer box crimping a multifilament yarn, which permit adjusting as precisely as possible in a widest possible range a twist impartation that is caused by a conveying fluid in the yarn channel.

A further object of the invention is to provide a method and an apparatus for stuffer box crimping multifilament yarns with a high flexibility and applicability.

SUMMARY OF THE INVENTION

The invention is based on the discovery that the action of the conveying fluid on the yarn within the yarn channel is not exclusively dependent on the geometry of the inflow conditions between the fluid feed channels and the yarn channel. An essential parameter for influencing the action of the conveying fluid on the yarn within the yarn channel is provided by the intensity of the flow. Thus, to achieve the object, the partial flows of the conveying fluid are introduced from the fluid feed channels into the yarn channel under the action of different overpressures. With that, adjustments are possible for taking in, guiding, and twisting the yarn inside the yarn channel, without changing any geometric arrangement.

It is thus possible to produce effects in the multifilament yarn, which would never be realized with geometric changes of the inflow conditions. In particular, in the production of a multicolor yarn, wherein a plurality of colored filament bundles jointly advance into the yarn channel, it is made possible to produce, besides a twisting action, additional separating actions for obtaining defined color effects. However, it is also possible to make an adjustment, which causes the yarn to advance to a yarn plug with few twists or without twist.

To this end, the apparatus for carrying out the method of the invention provides that at least one of the fluid feed channels is constructed such that the conveying fluid can be introduced from at least one of the fluid feed channels into the yarn channel under the action of an overpressure which is different from the overpressure at which the fluid is introduced from the other fluid feed channels. With that, it is possible to introduce, for example, inside the yarn channel a partial flow of the conveying fluid, which has a higher or, if need be, a lower volume flow than the other partial flows. Since the fluid flow in the yarn channel directly advances the yarn, it is thus possible to make very precise adjustments.

To be able to produce a most intensive possible twisting action, a variant of the method is especially advantageous, wherein a portion of the partial flows of the conveying fluid is introduced into the yarn channel in centric relationship therewith, and at least one further portion of the partial flow in off-center relationship. With that, it is possible to produce a twisting action that is caused by the inflow geometry, and which can additionally be increased or decreased by a higher or lower overpressure in one of the fluid feed channels.

However, it is also possible to introduce a greater portion of the partial flows of the conveying fluid directly in centric relationship with the yarn channel, and to produce it with the same overpressure. In this process, a partial flow of the conveying fluid that causes the twisting action on the yarn is introduced into the yarn channel in off-center relationship under the action of a higher overpressure or a lower overpressure. Such a variant of the method is of advantage in particular for the production of single-color yarns, wherein an excessive overtwisting of the yarn must be avoided for preventing a so-called cloud formation in the end product, for example, a carpet.

In this connection, it is possible to introduce a partial flow of the conveying fluid that is supplied in off-center relationship via a flow cross section of the fluid feed channel, which is substantially smaller than the other fluid feed channels.

To be able to apply the foregoing variants of the method as much as possible with a high flexibility and wide range of action, the apparatus of the invention comprises, preferably in the fluid feed channel, a pressure adjustment means, which permits changing the overpressure of the conveying fluid within the fluid feed channel.

Basically, however, it is also possible to construct the fluid feed channel with a fixed cross sectional narrowing or a narrow channel cross section, so that a pressure increase develops that is dependent on the source of pressure.

As pressure adjustment means it is possible to use an adjustable throttle inside the fluid feed channel, or a pressure valve upstream of the fluid feed channel, or a separate source of pressure.

However, it is also possible to form the pressure adjustment means by a suction device, which connects via a suction channel to the fluid feed channel, so that only a weak volume flow enters the yarn channel via the fluid feed channel.

The method and the apparatus of the invention are suited for any yarn type for producing crimped yarns, in particular carpet yarns. Thus, it is possible to produce fibers from polyester, polypropylene, or polyamide.

BRIEF DESCRIPTION OF THE DRAWINGS

In the following, the method of the invention is described in greater detail by reference to several embodiments of the apparatus of the invention, which are illustrated in the attached Figures, in which:

FIGS. 3.1; 3.2; and 3.3 show a plurality of schematic cross sectional views of a feed nozzle in the region of the conveying fluid supply;

DETAILED DESCRIPTION OF THE PREFERRED EMBODIMENTS

Figure 1:
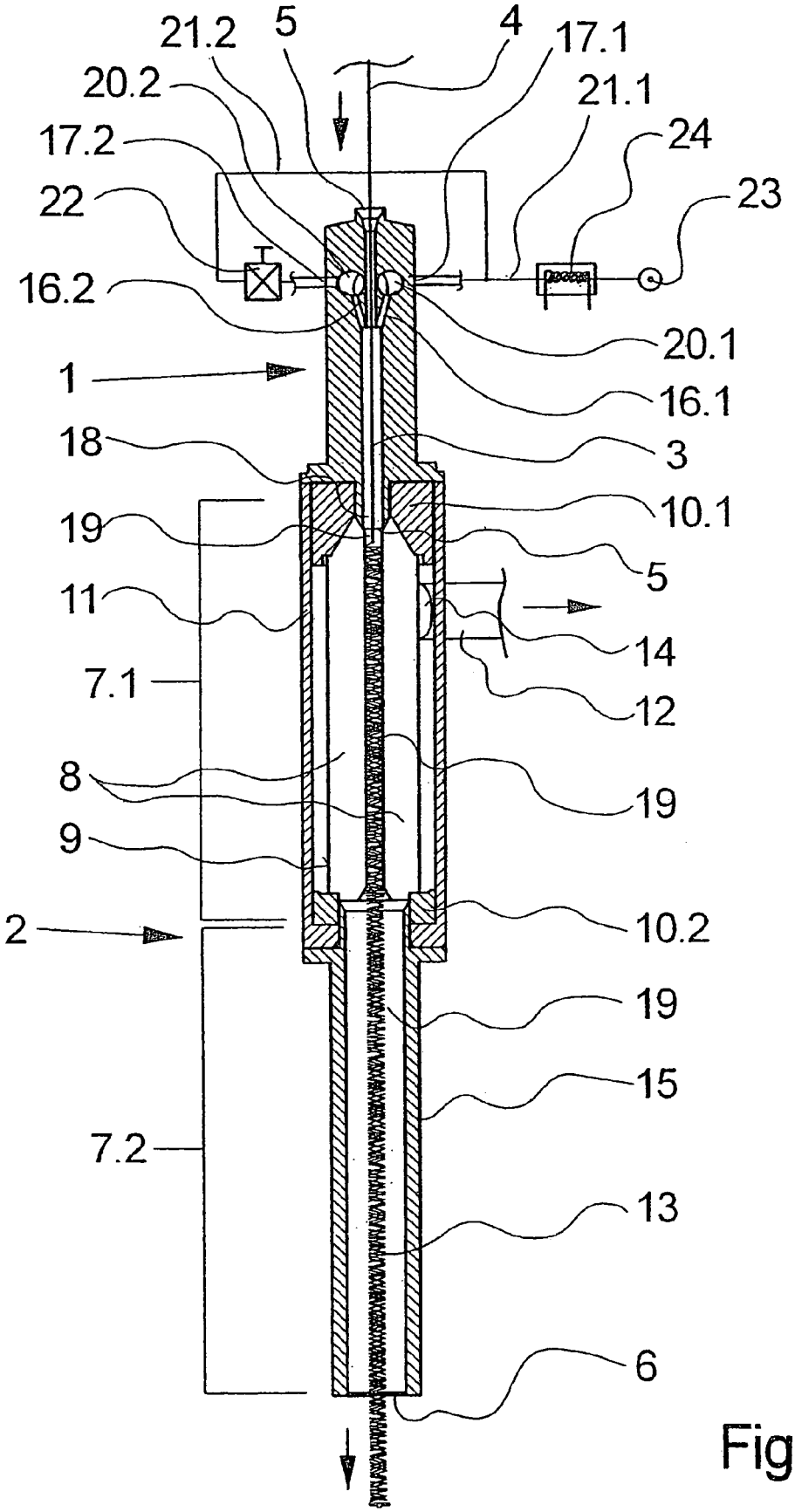
FIG. 1 is a schematic axially sectioned view of a first embodiment of the apparatus according to the invention.

Referring more particularly to the drawings, FIG. 1 schematically illustrates an axially sectioned view of a first embodiment of the apparatus according to the invention for carrying out the method of the invention. The apparatus comprises a feed nozzle 1 and a stuffer box chamber 2 downstream thereof. The feed nozzle 1 contains a yarn channel 3 which forms at its one end a yarn inlet 5 and at its opposite end a yarn outlet 18. The feed nozzle 1 connects via a first pressure connection 17.1 and a supply line 21.1 to a source of pressure 23. Inside the feed nozzle 1, the pressure connection 17.1 ends in a first pressure chamber 20.1. The first pressure chamber 20.1 connects with at least one fluid feed channel 16.1 which leads to the yarn channel 3.

Inside the feed nozzle 1, a second pressure chamber 20.2 is formed, which connects to the yarn channel 3 via at least one further fluid feed channel 16.2. The pressure chamber 20.2 connects via a pressure valve 22 and a supply line 21.2 to the source of pressure 23, which communicates with a pressure connection 17.2. For heating a conveying fluid that is made available by the source of pressure 23, a heating device 24 is arranged in the supply line 21.1 outside of the feed nozzle 1. The connection between the supply line 21.1 and the supply line 21.2 is formed, when viewed in the direction of flow, downstream of the heating device 24, so that the pressure chamber 20.2 likewise receives the heated conveying fluid. Basically, however, it is also possible to arrange the connection between the two supply lines 21.1 and 21.2, when viewed in the direction of flow, upstream of the heating device. In this instance, the pressure chamber 20.2 would receive an unheated conveying fluid.

The fluid feed channels 16.1 and 16.2 terminate in the yarn channel 3 such that a large component of the conveying fluid entering via the pressure chambers 20.1 and 20.2 through the fluid feed channels 16.1 and 16.2 flows into the yarn channel 3 in the direction of the advancing yarn. In this instance, each of the fluid feed channels 16.1 and 16.2 forms a separate partial flow of the conveying medium.

On its outlet end, the feed nozzle 1 is directly followed by the stuffer box chamber 2. The stuffer box chamber 2 is formed by an upper section with a gas-permeable wall 8 and a lower section with a closed chamber wall 15. The walls 8 and 15 form a plug channel 19, which connects at its upper end to the yarn outlet 18 of feed nozzle 1, and which forms at its lower end a plug outlet 6. In the present embodiment, the gas-permeable chamber wall 8 is formed by a plurality of lamellae 9 arranged in side-by-side relationship, which annularly extend at a small distance from one another. The lamellae 9 of the gas-permeable chamber wall 8 are held in an upper lamella holder 10.1 and in a lower lamella holder 10.2. Both the gas-permeable chamber wall 8 and the holders 10.1 and 10.2 are arranged in a closed casing 11. An annular space formed by the casing 11 connects via an opening 14 to a discharge duct 12.

In the embodiment of the apparatus according to the invention for carrying out the method of the invention as illustrated in FIG. 1, a yarn path is shown for explaining the operation of the apparatus. To begin with, a conveying fluid is made available to the feed nozzle 1 by the source of pressure 23. After heating the conveying fluid by the heating device 24, a partial volume of the conveying fluid is supplied via the pressure connection 17.1 to the pressure chamber 20.1 under an overpressure that is produced by the source of pressure 23. In the present embodiment, the overpressure in the pressure chamber 20.1 is designated $p_1$.

A second partial volume of the conveying fluid enters the second pressure chamber 20.2 via the pressure valve 22 and pressure connection 17.2. In so doing, the overpressure in the pressure chamber 20.2 is adjusted to an overpressure $p_2$ by the adjustable pressure valve 22. The overpressure $p_1$ in the pressure chamber 20.1 is thus higher than the overpressure $p_2$ in the pressure chamber 20.2. To form a first partial flow of the conveying fluid, the latter is conducted from the pressure chamber 20.1 through the fluid feed channel 16.1 into the yarn channel 3. In so doing, the conveying fluid is guided with a correspondingly high energy into the yarn channel 3 under the action of overpressure $p_1$. In contrast thereto, a low overpressure $p_2$ is operative for producing the second partial flow of the conveying fluid, which enters the yarn channel 3 via the fluid feed channel 16.2. Thus, the partial flows entering the yarn channel 3 act upon the yarn 4 with different flow energies, so that it is possible to make, for example, an advancing component of the conveying fluid stronger than a twisting component of the conveying fluid.

The conveying fluid advances the yarn 4 through the yarn channel into the adjacent stuffer box chamber 2. Inside the stuffer box chamber 2, a yarn plug 13 is formed, so that upon impacting upon the yarn plug 13, the yarn formed from a plurality of fine filaments collects in loops and coils on the surface of the yarn plug, and is compacted by the impact pressure of the conveying fluid. The conveying fluid flows off sideways from the openings formed between the lamellae 9, and is discharged via the opening 14 and discharge channel 12, preferably with the assistance of a suction device.

On the outlet side of the stuffer box chamber 2, the yarn plug 13 leaves through the plug outlet 6, and is continuously removed from the stuffer box chamber by a conveying means not shown. Preferably, the speed of the yarn plug 13 is adjusted such that the yarn plug height inside the stuffer box chamber 2 remains essentially constant. Normally, the yarn plug is again disentangled after being cooled and withdrawn at a higher speed. The crimped yarn forming in this process is subsequently wound to a package after a possible aftertreatment.

In the embodiment shown in FIG. 1, it is made possible to influence within a wide range the action of the conveying fluid inside the yarn channel on the multifilament yarn by separately adjusting the overpressures in the pressure chambers 20.1 and 20.2. Depending on the geometric arrangement of the inflow conditions, it is possible to intensify therewith the conveying action or the twisting action. In particular, the possibility of controlling the twist by changing the partial flows of the conveying fluid is very advantageous for the production of single-color or three-color yarns. Thus, it is possible to avoid, for example, in a single-color process the so-called overtwisting of the filaments by correspondingly adapting the overpressure. Likewise, it is possible to impart a twist to the yarn in the case of a plurality of filament bundles.

Figure 2:
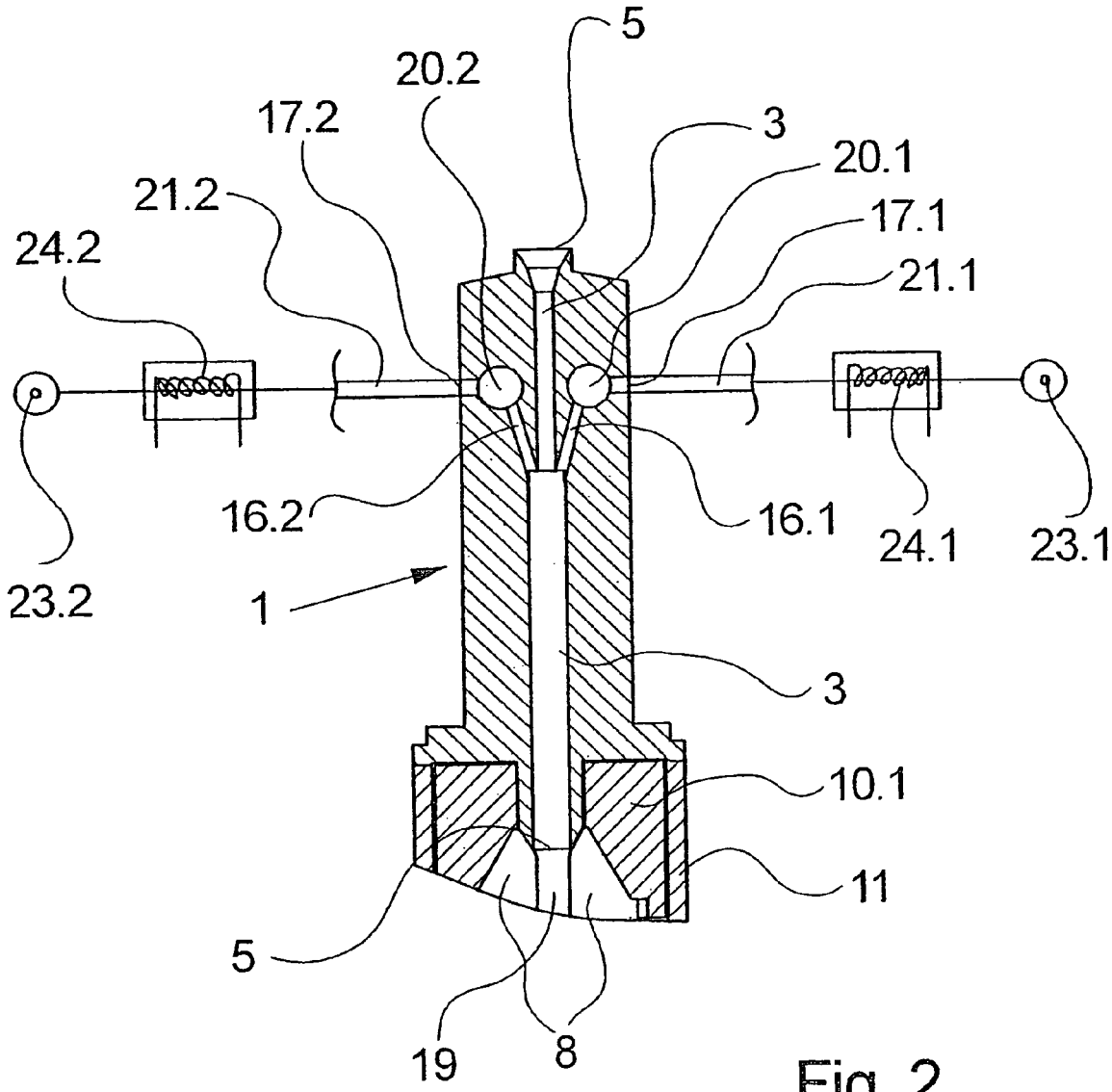
FIG. 2 is a schematic fragmentary view of a further embodiment of the apparatus according to the invention.

To be able to make the pressure adjustment in the pressure chambers of the feed nozzle as flexible as possible for producing the individual partial flows, a fragmentary view of a further embodiment of the apparatus according to the invention is schematically illustrated in FIG. 2. The embodiment of FIG. 2 is identical with the foregoing embodiment, so that only differences are described at this point.

In comparison with the previously described embodiment, each of the pressure chambers 20.1 and 20.2 connects to a separate source of pressure 23.1 and 23.2. To each source of pressure 23.1 and 23.2 a separate heating device 24.1 and 24.2 is associated, so that each of the partial flows of the conveying fluid generated inside the feed nozzle is tempered. However, it is also possible to adjust different temperatures of the partial flows. The overpressures of the conveying fluid that prevail in each of the pressure chambers 20.1 and 20.2 are adjusted by the associated sources of pressure 23.1 and 23.2.

In the case that a stationary compressed air network is used as source of pressure, it is possible to replace the sources of pressure 23.1 and 23.2 with a fluid adjustment device, which permits adjusting in each of the supply lines 21.1 and 21.2 as well as in the pressure chambers 20.1 and 20.2 a prevailing overpressure that is independent of the network pressure.

A particularly significant effect is achieved by the method and the apparatus of the invention in that both the generation of partial flows and the geometric arrangement of the fluid feed channels are adapted to the desired actions of the conveying fluid. To this end, a plurality of inflow geometries of a feed nozzle are shown in the fragmentary views of FIGS. 3.1–3.3, which show different possibilities of configuring the inflow geometry in a yarn channel of a feed nozzle, as is shown, for example, in the embodiments of FIGS. 1 and 2.

In the embodiment of the inflow geometry shown in FIG. 3.1, the fluid feed channels 16.1 and 16.2 are oriented in centric relationship with the yarn channel 3. Such an arrangement of the fluid feed channels substantially generates a strong conveying action on the yarn advancing in the yarn channel 3. In this case, the partial flows generated by different overpressures preferably lead to effects with very little twisting action.

To generate a most intensive possible twisting action on the multifilament yarn in the yarn channel, it is especially suitable to use the embodiment of FIG. 3.2. In this instance, at least one of the fluid feed channels 16.1 or 16.2 is arranged in off-center relationship with the yarn channel. The partial flow of the conveying fluid that is introduced through fluid feed channel 16.1 enters the yarn channel 3 in substantially tangential relationship and leads to a flow that largely rotates about the yarn. A second, opposite fluid feed channel 16.2 ends in the yarn channel 3 in substantially centric relationship.

To obtain a highest possible conveying action with little twisting action, a further possibility of the inflow geometry is shown in FIG. 3.3. In this instance, a greater portion of the partial flows enters the yarn channel in centric relationship. A third fluid feed channel 16.3 is arranged in off-center relationship with the yarn channel. In this arrangement, the fluid feed channel 16.3 has a substantially smaller channel cross section than the fluid feed channels 16.1 and 16.2 that are oriented with their outlets in centric relationship. The fluid feed channels 16.1 and 16.2 are operated preferably at the same overpressure level, so that the partial flows of the conveying fluid that are introduced from the fluid feed channels 16.1 and 16.2, enter the yarn channel with the same flow energy. The partial flow from the fluid feed channel 16.3, which produces a twisting action on the yarn, is supplied at a higher or lower overpressure level, so that a more or less strong partial flow jet enters the yarn channel 3 for influencing and twisting the yarn.

The embodiments of inflow geometries shown in FIGS. 3.1–3.3, however, are only exemplary. Basically, it is also possible that more than two fluid feed channels lead into the yarn channel. In addition, the opposite arrangement of the fluid feed channels is exemplary and in particular dependent on the type of construction of the feed nozzle. The embodiments illustrated in FIGS. 3.1–3.3 are based on a bipartite feed nozzle, wherein the feed nozzle is formed by two components that are held together along a parting line. Basically, however, it is also possible to form the feed nozzle as one component.

Figure 4:
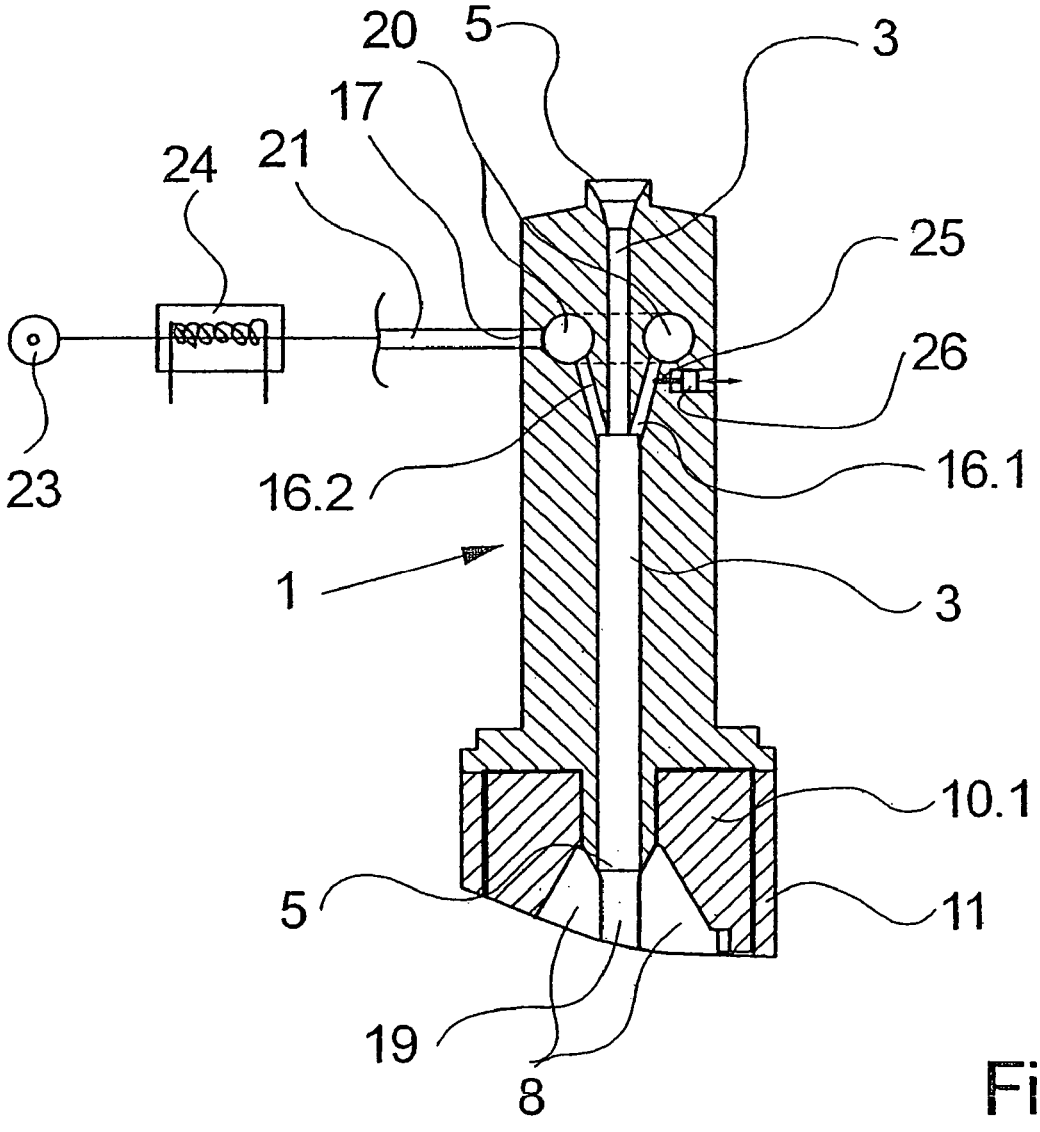
FIG. 4 is a schematic axially sectioned view of a further embodiment of the apparatus according to the invention.
Figure 5:
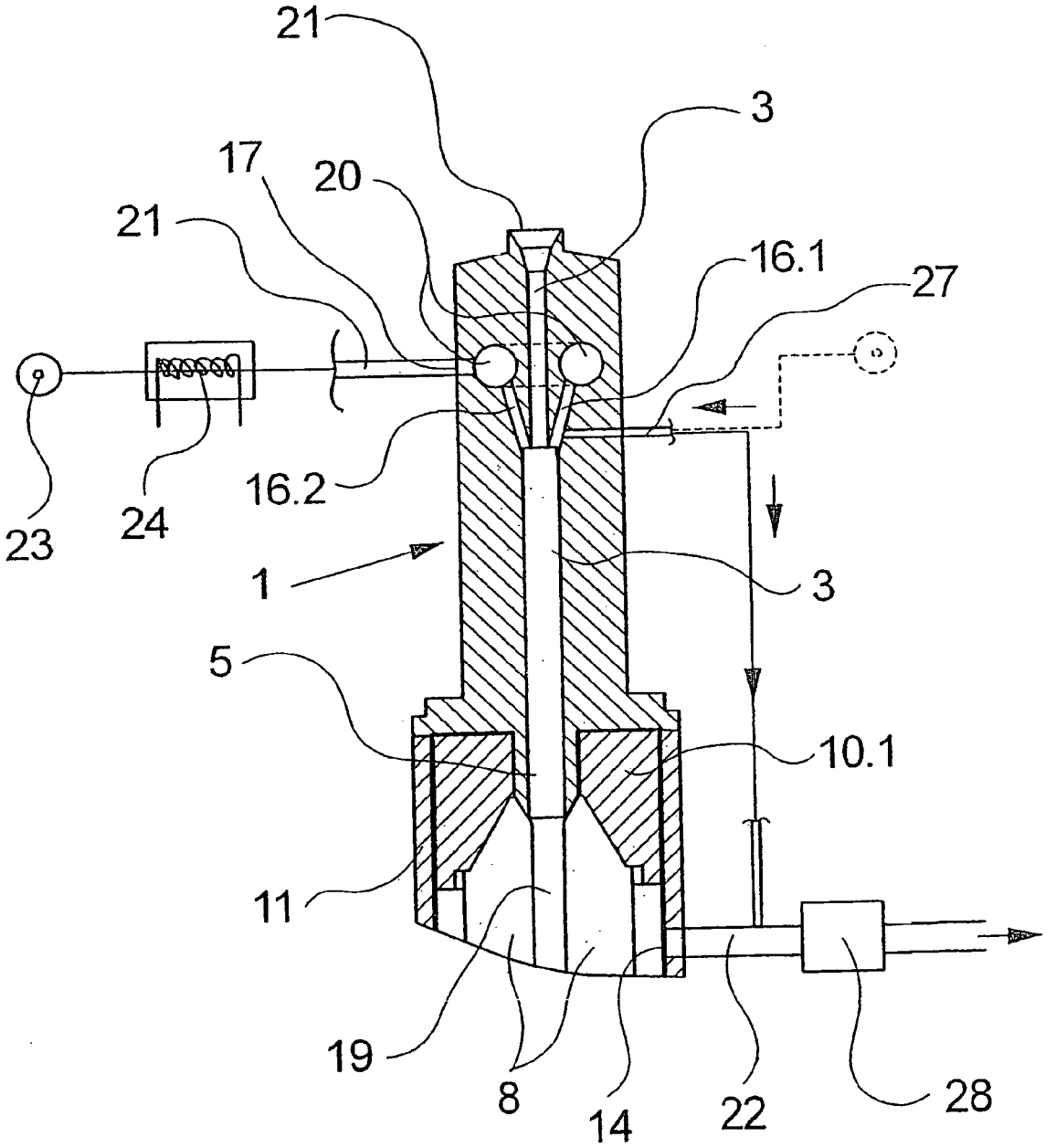
FIG. 5 is a schematic view of a further embodiment of the apparatus according to the invention for carrying out the method.

The following embodiments of FIGS. 4 and 5 show several further possibilities of constructing an apparatus according to the invention for carrying out the method of the invention. The embodiments are largely identical with the embodiments of FIGS. 1 and 2, so that only the differences are described.

In the embodiment shown in FIG. 4, the feed nozzle comprises a pressure chamber 20, which connects via a pressure connection 17 to a source of pressure 23. The pressure chamber 20 connects to the yarn channel via a plurality of fluid feed channels 16.1 and 16.2. To one of the fluid feed channels 16.1 a pressure adjustment means is associated in the form of a throttle 25. The throttle 25 includes a final control element 26, which influences more or less the free flow cross section of the fluid feed channel. To this end, the final control element 26 is made adjustable.

In the embodiment of FIG. 4, the throttle 25 permits adjusting different overpressures in the fluid feed channels 16.1 and 16.2, so that the partial flows advancing through the fluid feed channels 16.1 and 16.2 enter the yarn channel at a different volume flow.

In a further embodiment of FIG. 5, a suction channel 27 connects to the fluid feed channel 16.1 in the place of the throttle 25. The suction channel 27 connects to a suction device 28, which removes, for example, the conveying fluid from the stuffer box chamber through duct 12.

In this embodiment of the apparatus according to the invention, it is possible to remove a partial flow of the conveying fluid directly before entering the yarn channel, so that the partial flow generated via the fluid feed channel 16.1 turns out to be smaller than the partial flow of the conveying fluid that is introduced into the yarn channel 3 via the fluid feed channel 16.2.

As an alternative, however, it would also be possible to connect the suction channel 27 to a separate source of pressure (shown in phantom lines).

In this case, it would be possible to intensify the partial flow that enters from the fluid feed channel 16.1.

The invention claimed is:

1. A method for stuffer box crimping a multifilament yarn, comprising the steps of pneumatically advancing the yarn through a yarn channel and into a stuffer box chamber by introducing a conveying fluid into the yarn channel via a plurality of partial flows which are introduced from respective fluid feed channels which open into the yarn channel, forming the yarn into a yarn plug to compress the yarn as the plug advances through the stuffer box chamber and while the conveying fluid leaves the stuffer box chamber through openings and is discharged, and wherein the partial flows of the conveying fluid which are introduced into the yarn channel from the fluid feed channels are introduced under different overpressures.

2. The method of claim 1, wherein a portion of the partial flows of the conveying fluid is introduced into the yarn channel in centric relationship therewith, and at least one further portion of the partial flows of the conveying fluid is introduced in an off-center relationship therewith.

3. The method of claim 2, wherein the portion of the partial flows of the conveying fluid entering in centric relationship is introduced at a greater overpressure than the portion of the partial flows of the conveying fluid that is introduced in off-center relationship.

4. The method of claim 2, wherein the portion of the partial flows of the conveying fluid entering in off-center relationship is introduced at a greater overpressure than the portion of the partial flows of the conveying fluid that is supplied in centric relationship.

5. The method of claim 1, wherein the greater portion of the partial flows of the conveying fluid is introduced in centric relationship with the yarn channel and generated at the same overpressure, and that a further partial flow of the conveying fluid is introduced into the yarn channel in off-center relationship under the action of a higher overpressure or a lower overpressure.

6. The method of claim 5, wherein the partial flow of the conveying fluid that is supplied in off-center relationship is generated by one of the fluid feed channels having a smaller flow cross section than the other fluid feed channels.

7. The method of claim 5, wherein the partial flow of the conveying fluid that is supplied in off-center relationship is generated by a controllable overpressure.

8. The method of claim 1, wherein the fluid feed channels have identical flow cross sections, and the overpressures of the partial flows are generated by a source of pressure or by changing at least one of the flow cross sections.

9. The method of claim 1, wherein the fluid feed channels have identical flow cross sections, and the overpressures of the partial flows are generated by a source of pressure or by removing in part at least one of the partial flows by suction.

10. The method of claim 1, wherein the fluid feed channels have identical flow cross sections, and the overpressures of the partial flows are generated by a plurality of sources of pressure.

11. The method of claim 1, wherein the fluid feed channels have different flow cross sections, and the overflows of the partial pressures are generated by one source of pressure.

12. An apparatus for stuffer box crimping a multifilament yarn, comprising a feed nozzle for pneumatically advancing the yarn, a stuffer box chamber positioned downstream of the feed nozzle for receiving the yarn and forming a yarn plug, said feed nozzle comprising a yarn channel and a plurality of fluid feed channels which lead into the yarn channel, with the fluid feed channels being connected to source of fluid under pressure for providing a conveying fluid, and wherein at least one of the fluid feed channels is configured such that the conveying fluid can be introduced from the one fluid feed channel into the yarn channel at an overpressure which is different from the overpressure at which the fluid is introduced from the other fluid feed channels.

13. The apparatus of claim 12, wherein a pressure adjustment means permits changing the overpressure of the conveying fluid within the at least one fluid feed channel.

14. The apparatus of claim 12, wherein the at least one fluid feed channel comprises a fixed cross sectional narrowing or a narrow channel cross section, which is substantially smaller than the channel cross sections of the other fluid feed channels.

15. The apparatus of claim 12, wherein the outlet of the at least one fluid feed channel is formed in centric or off-center relationship with the yarn channel.

16. The apparatus of claim 13, wherein the pressure adjustment means is formed by an adjustable throttle within the at least one fluid feed channel.

17. The apparatus of claim 13, wherein the pressure adjustment means is formed by a pressure valve upstream of the at least one fluid feed channel.

18. The apparatus of claim 17 wherein all of the fluid feed channels are connected to a common source of fluid under pressure.

19. The apparatus of claim 13, wherein the pressure adjustment means is formed by a first source of fluid under pressure which connects to the at least one of the fluid feed channels and a second source of fluid under pressure which connects to the other fluid feed channels.

20. The apparatus of claim 13, wherein the pressure adjustment means is formed by a suction device which connects via a suction channel to the at least one fluid feed channel.

* * * * *